US005285633A

United States Patent [19]

Duva

[11] Patent Number: 5,285,633

[45] Date of Patent: Feb. 15, 1994

[54] COOLANT SUBSYSTEM FOR A TORPEDO PROPULSION SYSTEM

[75] Inventor: Anthony W. Duva, Middletown, R.I.

[73] Assignee: The United States of America as represented by the Secretary of the Navy, Washington, D.C.

[21] Appl. No.: 35,864

[22] Filed: Mar. 23, 1993

[51] Int. Cl.[5] ..... F02G 3/02; F42B 19/12

[52] U.S. Cl. ..... 60/39.63; 60/39.402; 114/20.2

[58] Field of Search ..... 60/39.462, 39.6, 39.63; 91/499, 503, 507; 114/20.2; 123/41.01, 41.02, 41.09

[56] References Cited

U.S. PATENT DOCUMENTS

| | | | |
|---|---|---|---|
| 1,765,637 | 6/1930 | Thompson | 123/41.09 |
| 3,151,527 | 10/1964 | Hamlin | 91/507 |
| 3,408,898 | 11/1968 | Hamlin | 91/499 |
| 3,564,846 | 2/1971 | Moore | 60/39.462 X |

*Primary Examiner*—Michael Koczo
*Attorney, Agent, or Firm*—Michael J. McGowan; Prithvi C. Lall; Michael F. Oglo

[57] ABSTRACT

A coolant subsystem for a torpedo propulsion system having an external combustion expansion engine. The coolant subsystem includes a valve which provides for one-way flow through the coolant subsystem. Inclusion of the valve prevents a backflow of exhaust gas into the coolant subsystem, thereby reducing the risk of torpedo failure due to engine overheating when the torpedo is launched in shallow water.

7 Claims, 2 Drawing Sheets

COOLANT SUBSYSTEM FOR A TORPEDO PROPULSION SYSTEM

STATEMENT OF GOVERNMENT INTEREST

The invention described herein may be manufactured and used by or for the Government of the United States of America for governmental purposes without the payment of any royalties thereon or therefor.

CROSS REFERENCES TO RELATED PATENT APPLICATIONS

The instant application is related to two co-pending U.S. patent applications entitled TORPEDO WITH COMBUSTION ENGINE HAVING AN EXPANSION CHAMBER, Ser. No. 08/035,862, Filed in Mar. 23, 1993; and HEAT REGENERATIVE EXTERNAL COMBUSTION ENGINE, Ser. No. 08/035,867 having same filing date.

BACKGROUND OF THE INVENTION (1) Field of the Invention

This invention relates generally to torpedoes, and more particularly relates to a coolant subsystem for cooling the combustion chamber and/or cylinders of a torpedo propulsion system.

(2) Description of the Prior Art

Conventional torpedo engines employ coolant subsystems which rely upon seawater as a cooling medium. Generally, such coolant subsystems include a water inlet for receiving seawater, which is then pumped through the engine and emitted from the torpedo with the exhaust gas. While this type of coolant subsystem is reliable when a torpedo is launched from a substantial depth, torpedoes launched in shallow water will, on occasion, shut down and not complete their mission requirements. While numerous attempts have been made to determine the cause of such failures and to eliminate them, prior attempts have been only marginally successful in reducing the rate of engine failure, primarily because they have been unsuccessful in determining the actual cause of engine shutdown. Failure rates were reduced somewhat by implementation of engine start-up software changes, however a 3–5% failure rate has continued.

SUMMARY OF THE INVENTION

It is an object of the invention to provide an improved torpedo engine coolant subsystem.

Another object of the invention is to provide a coolant subsystem which substantially reduces the failure rate of torpedo engines when the torpedoes are launched in shallow water.

Another object of the invention is to provide a method for reducing the failure rate of torpedo engines.

Yet another object of the invention is to provide a method for improving the efficiency of initiating coolant flow through a coolant subsystem for a torpedo engine.

These and other objects of invention will become more apparent from the following description.

The present invention is based upon the inventor's determination of the cause of combustion chamber failure in a torpedo engine. As a result of tests conducted under the supervision of the inventor, it was determined that during relatively shallow launch conditions, the flow of cooling water through the coolant subsystem of a torpedo engine can be disrupted by the entry of exhaust gas from the engine cylinder into the coolant subsystem. More particularly, under conditions in which the pressure at the cooling water inlet to the torpedo is relatively low, the spent gas from the engine cylinder not only exits through the exhaust gas valve, but also exits through the cooling water inlet, thereby preventing the entry of seawater into the coolant subsystem. The lack of cooling water then causes the combustion chamber to overheat and separate from the splined valve. As a result, the torpedo shuts down and therefore does not complete its mission requirement. The present invention overcomes this problem by providing an apparatus and method for eliminating the path for exhaust displacement of cooling water.

The above-mentioned objects of the invention are realized by providing an improved coolant subsystem for a torpedo propulsion system. The coolant subsystem is adapted for use with a torpedo propulsion system having an external combustion expansion engine. The propulsion system includes a combustion chamber having an initiator monopropellant disposed therein to generate an energized gas to commence drive action of the torpedo propulsion system and to commence the entry of a sustainer monopropellant into the combustion chamber. The sustainer propellant is then combusted to form an energized gas. The energized gas generated by the initiator and sustainer propellants is fed to an engine cylinder through an energized gas line in a rotary valve. The energized gas is expanded in the engine cylinder to drive the drive shaft. The expanded gas is then fed from the engine cylinder through an exhaust gas line in the rotary valve to an exhaust gas channel, through which it is removed from the torpedo propulsion system.

The coolant subsystem of the invention includes an inlet for admitting seawater coolant into the torpedo. The inlet is fluidly connected to a coolant passage formed around a portion of the combustion chamber and engine cylinder to allow for cooling of the same. The subsystem also includes a coolant pump which, upon a momentary lapse of time after torpedo launch, impels seawater at the coolant inlet through the coolant passage, through a coolant line in the rotary valve, and into the exhaust gas channel to be removed from the torpedo with the expanded gas. The coolant subsystem further includes means disposed in the path of the seawater coolant to substantially prevent a backflow of exhaust gas through the coolant passage during the momentary lapse of time after drive action is commenced and before the pump impels seawater through the coolant passage. The means to prevent a backflow of exhaust gas preferably is a check valve which is placed in the coolant passage.

According to a particularly preferred embodiment of the invention, the means to prevent a backflow of exhaust gas is included in the pump head of the coolant pump. Preferably, the momentary lapse of time after the commencement of drive action and before the pump impels seawater through the cooling passage is no more than about 300 milliseconds, and the initiator propellant is the sole source of propellant gas for about 400 milliseconds, at which time fuel begins to enter the combustion chamber.

The invention further comprises a method for reducing the failure rate of an external combustion torpedo engine, comprising the step of installing a check valve in an otherwise conventional coolant subsystem for an external combustion torpedo engine. The check valve preferably is positioned downstream from the coolant pump and upstream from the rotary valve.

BRIEF DESCRIPTION OF THE DRAWINGS

Other objects, features and advantages of the present invention will become apparent upon reference to the following description of the preferred embodiments and to the drawings, wherein.

DETAILED DESCRIPTION OF THE PREFERRED EMBODIMENT

Figure 1:
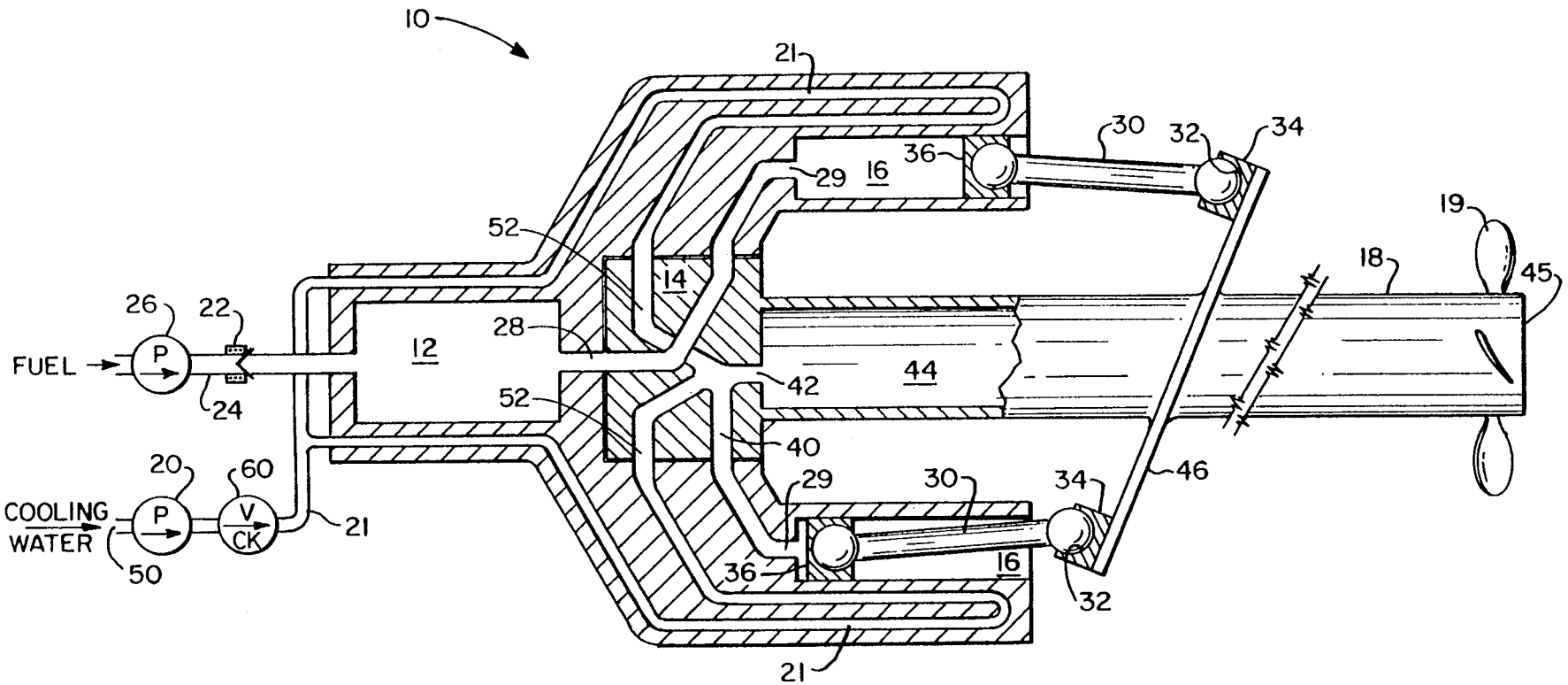
FIG. 1 schematically shows a torpedo engine having a coolant subsystem according to the present invention, and FIG. 2 schematically shows a preferred coolant pump head in accordance with the present invention.

With reference to FIG. 1, a torpedo engine having an improved coolant subsystem according to the invention is generally designated by the numeral 10. The torpedo engine 10 is an external combustion engine having a cylindrical combustion chamber 12 for generating an energized combustion gas from a monopropellant fuel. The energized gas is transferred through a conventional rotary valve 14 to six cylinders 16 that are arranged around a central drive shaft 18, which is coaxial with, and splined to, the rotary valve 14. The gas is expanded in the cylinders 16 in order to drive the drive shaft 18. A propeller 19 is positioned at the outer end of the drive shaft 18 for propelling the torpedo after it is launched. The coolant subsystem includes a coolant pump 20 and a coolant passage 21 for circulating seawater around the combustion chamber 12 and the cylinders 16 during operation of the engine.

The torpedo engine operates in the following manner. Before the torpedo is launched, the combustion chamber 12 contains a solid initiator monopropellant (not shown) which is ignited when launch occurs. As the initiator propellant combusts, it generates a hot, energized gas which commences drive action of the torpedo engine 10 and opens a poppet valve 22 at a fuel inlet port 24 to the combustion chamber 12 to admit a liquid sustainer propellant into the combustion chamber 12. The sustainer propellant, which is a monopropellant fuel, such as OTTO Fuel II, is pumped by a pump 26 through the fuel inlet port 24 into the combustion chamber 12. The heat generated by combustion of the initiator propellant commences combustion of the sustainer propellant to form a hot, high-pressure, energized gas. Commonly, the operating pressure in the combustion chamber 12 is on the order of 700–900 p.s.i. As a portion of the energized gas in the combustion chamber 12 is expelled from the combustion chamber in a conventional manner as will be described, additional sustainer propellant is pumped into the combustion chamber 12 and is combusted due to the high temperature and pressure in the chamber 12.

Energized gas is expelled (or removed) from the combustion chamber 12 through an energized gas channel 28 in the rotary valve 14. The energized gas is distributed through the energized gas channel 28 in sequence to the six cylinders 16, which are evenly spaced from each other and from the drive shaft 18. Two of the six cylinders are seen in FIG. 1. The energized gas is delivered sequentially via the energized gas channel 28 to the inlet 29 of each cylinder. The inlets 29 are positioned around the rotary valve 14 for sequential registry with the channel 28 in a known manner as the rotary valve rotates.

Each cylinder 16 contains a reciprocating piston 30 which is connected at its outer end 32, outside the cylinder body, to a non-rotating (but pivoting) wobble plate 34 which is configured in a conventional manner. The energized gas which is distributed to the cylinders 16 performs work on the pistons 30 sequentially by individually moving the inner end 36 of each piston 30 outward, toward the rear end of the torpedo engine. Due to the interconnection of all of the pistons 30 by the tilted wobble plate 34, outward movement of one particular piston 30 causes a piston on the directly opposite, axially spaced side of the drive shaft to move inward, away from the rear end of the torpedo engine. As a particular piston 30 moves inward, it forces expanded gas through an exhaust gas channel 40 in the rotary valve 14 in a known manner. The gas in the exhaust gas channel 40 is introduced into an exhaust gas-coolant channel 42 in the rotary valve 14 and is subsequently transferred to an elongated exhaust duct 44 which is located within the drive shaft 18. The exhaust gas is then emitted from the torpedo engine 10 into the seawater at the outer end 45 of the exhaust duct 44.

The wobble plate 34 is connected by a bearing to a tilted, rotating swash plate 46. The non-rotating, wobbling movement of the wobble plate 34 rotates the swash plate 46 continuously in one direction to drive the central drive shaft 18, which is rigidly connected to the swash plate 46 in a co-axial arrangement. Rotation of the drive shaft 18 drives the propeller 19, which is fixed to the outer end of the drive shaft 18.

The coolant subsystem for the torpedo engine 10 includes a seawater inlet 50 which is opened after the torpedo is launched. The inlet 50, which is near the combustion chamber 12, admits cooling water into the coolant passage 21. The seawater at inlet 50 is pumped through the coolant passage 21 by the coolant pump 20. The coolant passage 21 includes annular segments formed around the outer surface of the combustion chamber 12 and around at least a portion of each of the six cylinders 16. After circulating around the combustion chamber 12 and cylinders 16, the seawater in passage 21 enters a coolant channel 52 in the rotary valve 16 in a conventional manner and is then transferred into the exhaust gas-coolant channel 42 in the rotary valve 14, where it is mixed with exhaust gas and is subsequently removed from the torpedo engine with the exhaust gas through the exhaust duct 44. To this extent, the coolant subsystem of the invention is known.

According to the present invention, the cause of engine failure for torpedoes launched in shallow water has been determined, and the problem of engine failure subsequently has been solved. Under shallow launch conditions, the inventor found that in a conventional torpedo, exhaust gas from the exhaust gas channel in the rotary valve enters the coolant channel in the rotary valve in a direction opposite to the direction of coolant flow, caused by hot gas choking. The choking increases the coolant subsystem pressure to the stagnation pressure for choked flow in the exhaust gas channel. Therefore, the pressure in the coolant channel and exhaust channel becomes pressurized over the depth pressure of the torpedo. This pressurization occurs before the coolant pump is opened, due to design limitations of the coolant subsystem. As a result, a backflow of exhaust gas enters the coolant channel. When operation of the coolant pump is commenced, exhaust gas exits through the seawater inlet. This backflow of exhaust gas prevents cooling water from entering the coolant subsystem. Due to a lack of coolant in the coolant passage, the combustion chamber overheats and separates from the rotary valve, causing engine failure.

In order to prevent torpedo engine failure of the type described above in the preceding paragraph, the present invention incorporates a check valve 60 in the coolant passage 21. The check valve or valves can be located at any point along the coolant passage 21 upstream from the rotary valve and downstream from the outlet of the coolant pump 20. Preferably, for ease of construction, the check valve is positioned on the head of the coolant pump. The check valve 60, which permits fluid flow only in the direction of intended coolant flow, allows the coolant pump 20 to be unbiased to the coolant system pressure before the seawater inlet 50 is opened. If choking occurs, the check valve 60 prevents the entry of exhaust into the upstream side of the coolant pump 20 and therefore prevents exhaust gas from exiting through the seawater inlet 50. The valve 60 remains closed temporarily, allowing the coolant pump 20 to prime itself. After the coolant pump 20 is primed, the water pressure from the coolant pump 20 is greater than the exhaust back pressure, and forces the check valve 60 open. As a result, the torpedo engine 10 operates in a normal manner.

Figure 2:
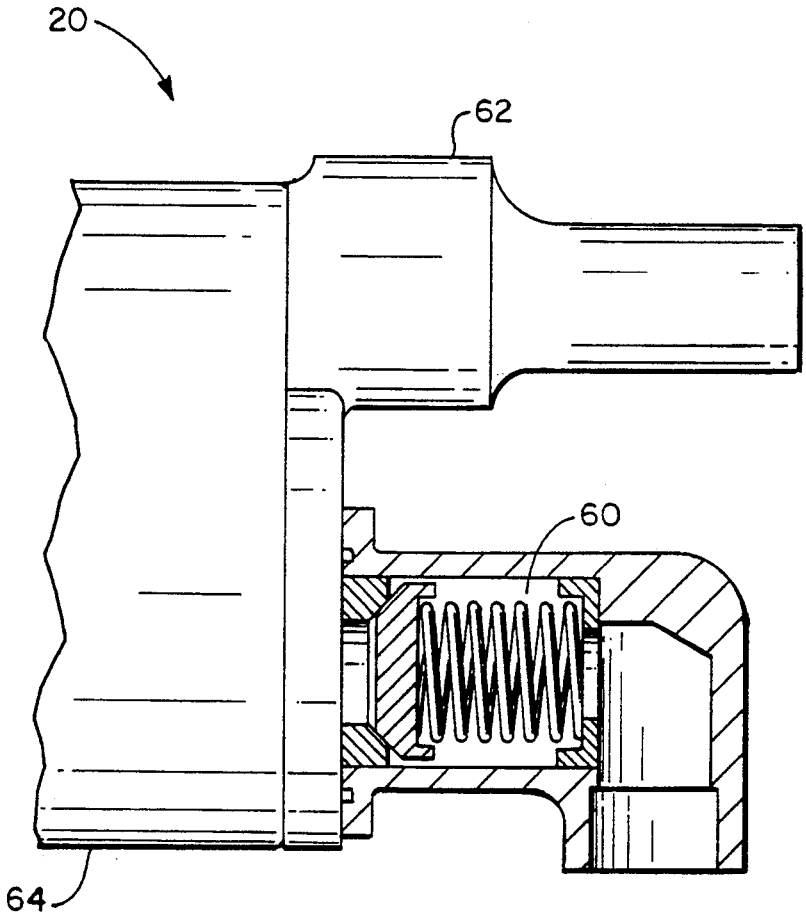

Referring now to FIG. 2, the particularly preferred check valve 60 of the present invention is shown schematically in further detail. The check valve 60 can be of any type, and preferably is a cartridge-type, low pressure drop check valve. The pump 20 includes a pump head 62 and pump body 64 through which the coolant flow passes. Preferably, the check valve 60 is mounted on the pump head 64. The improved coolant subsystem can be installed economically by building a new pump head with the check valve 60 mounted thereon and using this new pump head with otherwise conventional torpedo engine components.

It is to be understood that various changes and details, materials, steps, and arrangement of parts, which have been here described and illustrated in order to explain the nature of the invention, may be made by those skilled in the art, within the principle and scope of the invention as expressed in the appended claims.

What is claimed is:

1. In a torpedo with a propulsion system having an external combustion engine for driving a drive shaft, the propulsion system including a combustion chamber having an initiator propellant disposed therein to generate an energized gas upon torpedo launch to commence drive action of the drive shaft and to effect admission into the combustion chamber of a sustainer monopropellant which is combusted to form an energized gas, at least one cylinder for receiving and expanding the energized gas, an exhaust gas channel for removing expanded gas from the propulsion system, and rotary valve means for transferring the energized gas from the combustion chamber to the at least one engine cylinder and for transferring the expanded gas from the at least one cylinder into the exhaust gas channel, the rotary valve means being interconnected to the drive shaft, a coolant subsystem comprising, in combination:

an inlet for admitting a seawater coolant;

a coolant passage fluidly connected to the inlet and extending around a portion of at least one of the combustion chamber and the at least one cylinder;

a coolant pump which, upon a momentary lapse of time after torpedo launch, impels the coolant admitted to the coolant subsystem inlet through the coolant passage, through the rotary valve and into the exhaust gas channel through which it exits the torpedo in a mixture with the exhaust gas; and means disposed in the path of the seawater coolant to prevent a backflow of exhaust in the coolant passage during the momentary lapse of time after drive action is commenced and before the pump impels seawater through the coolant passage.

2. The coolant subsystem of claim 1, wherein the means to prevent a backflow of exhaust gas is a check valve.

3. The coolant subsystem of claim 1, wherein:

the pump includes a pump body and a pump head; and the means to prevent a backflow of exhaust gas is positioned downstream from the pump body.

4. The coolant subsystem of claim 3, wherein the means to prevent a backflow of exhaust gas is positioned upstream from the rotary valve.

5. The coolant subsystem of claim 1, wherein the means to prevent a backflow of an exhaust gas is formed on the pump head.

6. The coolant subsystem of claim 1, wherein the coolant pump is so constructed and arranged to impel the coolant admitted to the coolant subsystem inlet through the coolant passage no more than about 300 milliseconds after the torpedo is launched.

7. The coolant subsystem of claim 1, wherein the coolant pump is so constructed and arranged to impel the coolant admitted to the coolant subsystem inlet through the coolant passage before the sustainer monopropellant fuel begins to enter the combustion chamber.

* * * * *